US006955141B2

(12) United States Patent
Santanam et al.

(10) Patent No.: US 6,955,141 B2
(45) Date of Patent: Oct. 18, 2005

(54) ENGINE COOLING SYSTEM

(75) Inventors: Chandran B. Santanam, Rochester Hills, MI (US); Dimitrios Rizoulis, Ann Arbor, MI (US); Balaji Maniam, Rochester Hills, MI (US); Gary D. Mandrusiak, Utica, MI (US)

(73) Assignee: General Motors Corporation, Detroit, MI (US)

( * ) Notice: Subject to any disclaimer, the term of this patent is extended or adjusted under 35 U.S.C. 154(b) by 98 days.

(21) Appl. No.: 10/635,131

(22) Filed: Aug. 6, 2003

(65) Prior Publication Data

US 2005/0028756 A1 Feb. 10, 2005

(51) Int. Cl.[7] ..... F01P 7/14
(52) U.S. Cl. ..... 123/41.08; 123/41.29
(58) Field of Search ..... 123/41.08, 41.29

(56) References Cited

U.S. PATENT DOCUMENTS 3,211,374 A * 10/1965 Matulaitis ..... 237/8 R
4,319,547 A * 3/1982 Bierling ..... 123/41.29
4,327,674 A * 5/1982 Takei ..... 123/41.12
4,369,738 A * 1/1983 Hirayama ..... 123/41.1
4,381,736 A * 5/1983 Hirayama ..... 123/41.1
4,977,862 A * 12/1990 Aihara et al. ..... 123/41.12
5,121,714 A * 6/1992 Susa et al. ..... 123/41.1
5,828,967 A * 10/1998 Ueda ..... 701/1
5,950,576 A * 9/1999 Busato et al. ..... 123/41.08
6,516,755 B2 * 2/2003 Gregory ..... 123/41.1
2004/0060524 A1 * 4/2004 Hwang et al. ..... 123/41.28

* cited by examiner

*Primary Examiner*—Thomas Moulis
(74) *Attorney, Agent, or Firm*—Leslie C. Hodges

(57) ABSTRACT

A cooling system has a diverter valve to selectively control the flow of coolant through an internal combustion engine having a cylinder block with a cooling jacket and a cylinder head mounted on the block with a cooling jacket. A controller, responsive to the temperature of the block and the head, controls the diverter valve and a water pump to provide adequate coolant flow through the head and the block as needed to maintain optimal operating temperatures. After the engine is shut off, the controller continues to operate the water pump and a cooling fan to continue to cool the engine for a period of time.

21 Claims, 2 Drawing Sheets

ENGINE COOLING SYSTEM

TECHNICAL FIELD

This invention relates to a cooling system for a liquid cooled internal combustion engine and, more particularly, to a method and means for controlling liquid coolant flow through the system.

BACKGROUND OF THE INVENTION

An internal combustion engine commonly employs a pressurized cooling system with a circulating liquid coolant for cooling the engine. Engine heat is transferred from the engine to the coolant in a cooling jacket surrounding combustion heated parts of the engine. The heat absorbed by the circulated coolant is generally dissipated by a heat exchanger into the air.

Under normal operating conditions, an engine may require only nominal coolant flow to maintain proper temperature of internal components. However, under severe conditions an engine requires increased coolant flow to maintain proper component temperature. If a high flow rate water pump is used to provide a high coolant flow rate under severe conditions to prevent engine overheating, the amount of coolant flow will be excessive under normal operating conditions, resulting in parasitic energy losses.

Since water pumps are commonly mechanically driven by an engine, the flow of coolant through the engine stops when the engine shuts down. The lack of coolant circulation after an engine stops allows engine heat to soak into the coolant which remains in the engine and slows the cooling process.

A method of more efficiently controlling engine coolant temperature and of continuing cooling of an engine after shut down is desired.

SUMMARY OF THE INVENTION

The present invention minimizes parasitic losses in a vehicle internal combustion engine cooling system, by using optionally a variable speed water pump and a diverter valve to selectively increase or decrease the flow of coolant through cooling jackets of the engine. In addition, the present invention may also cool the engine after the engine is shut down, by using an electric pump to circulate coolant and a reversible fan to control air flow in the engine compartment and through the heat exchanger.

In a preferred embodiment, the engine has a cylinder block with a cooling jacket and a cylinder head mounted to the block with a cooling jacket. The cooling jacket of the block has an internal connection with the cooling jacket of the head. A first coolant inlet in the block and a second coolant inlet in the head receive coolant from a diverter valve. A coolant outlet in the head carries all the coolant discharged from the engine.

The engine has two cooling jacket flow paths. The first coolant flow path conducts coolant from the inlet of the block, through the cooling jacket of the block and into the cooling jacket of the head to the coolant outlet in the head. The second coolant flow path conducts coolant through the inlet of the head into the cooling jacket of the head and out of the engine through the coolant outlet in the head.

The coolant outlet is connected to a heater core and a temperature control valve. Coolant flowing to the heater core is used to transfer heat to the vehicle passenger compartment. The outlet of the heater core is connected to the water pump, which recirculates the coolant through the system.

Coolant flowing to the temperature control valve is directed either to a heat exchanger or to a heat exchanger bypass connected to the inlet of the water pump. The temperature control valve operates to selectively bypass the flow of coolant around the heat exchanger when the coolant is below optimal temperature. As the coolant approaches optimal operating temperature, the temperature control valve gradually opens and allows coolant to flow through the heat exchanger to be cooled as needed to maintain the optimal operating temperature of the coolant. The coolant that bypasses the heat exchanger flows to the water pump and is recirculated through the system.

Coolant is circulated through the system, preferably by a variable speed electric water pump. The flow of coolant is directed with a diverter valve connected between the pump and the engine. The diverter valve controls the flow of coolant through the head and the block. The pump determines the overall system flow rate while the diverter valve determines the direction of flow through the cooling jackets of the engine. Control of the flow of coolant with the pump and the diverter valve is optimized to increase engine efficiency.

Heat pipes can be installed at critical locations of the head such as at valve bridges or around the spark plugs to increase thermal conductivity of the head and carry more heat to the cooling jackets. As a result, the critical metal temperatures in the head are reduced and the amount of heat dissipated to the coolant is increased, thereby further increasing system efficiency.

Temperature sensors located in the block and in the cylinder head send signals to a controller. The temperature information is processed by the controller and outputs are sent to the diverter valve to alter coolant flow rates through the engine as necessary to maintain optimal coolant temperatures in the head and the block. The controller may also send outputs to a variable speed fan, the water pump, and the temperature control valve to further control coolant temperature and flow rates through the system.

Other factors such as fuel flow rate, air flow rate, engine knock and nucleate boiling of the coolant may also be utilized by the controller to determine the proper coolant flow rates through the engine. When the engine is below optimal operating temperature, the controller actuates the diverter valve to circulate most of the coolant through the cylinder head of the engine to maintain a lower operating temperature in the cylinder head than the block. As the block reaches optimal operating temperature, the controller actuates the diverter valve to provide additional coolant to the block of the engine. As the coolant reaches optimal operating temperature, the temperature control valve directs engine coolant flow through the heat exchanger as needed to maintain optimal coolant temperature.

After the engine is shut down, the controller continues to operate the water pump to maintain the flow of coolant through the engine. The controller may also reverse the direction of the heat exchanger fan to direct air from under the engine compartment through the heat exchanger and out of the engine compartment. This reduces the temperature of the air in the engine compartment and prevents air heated by the heat exchanger from being directed into the engine compartment.

These and other features and advantages of the invention will be more fully understood from the following description of certain specific embodiments of the invention taken together with the accompanying drawings.

DESCRIPTION OF THE PREFERRED EMBODIMENT

Figure 1:
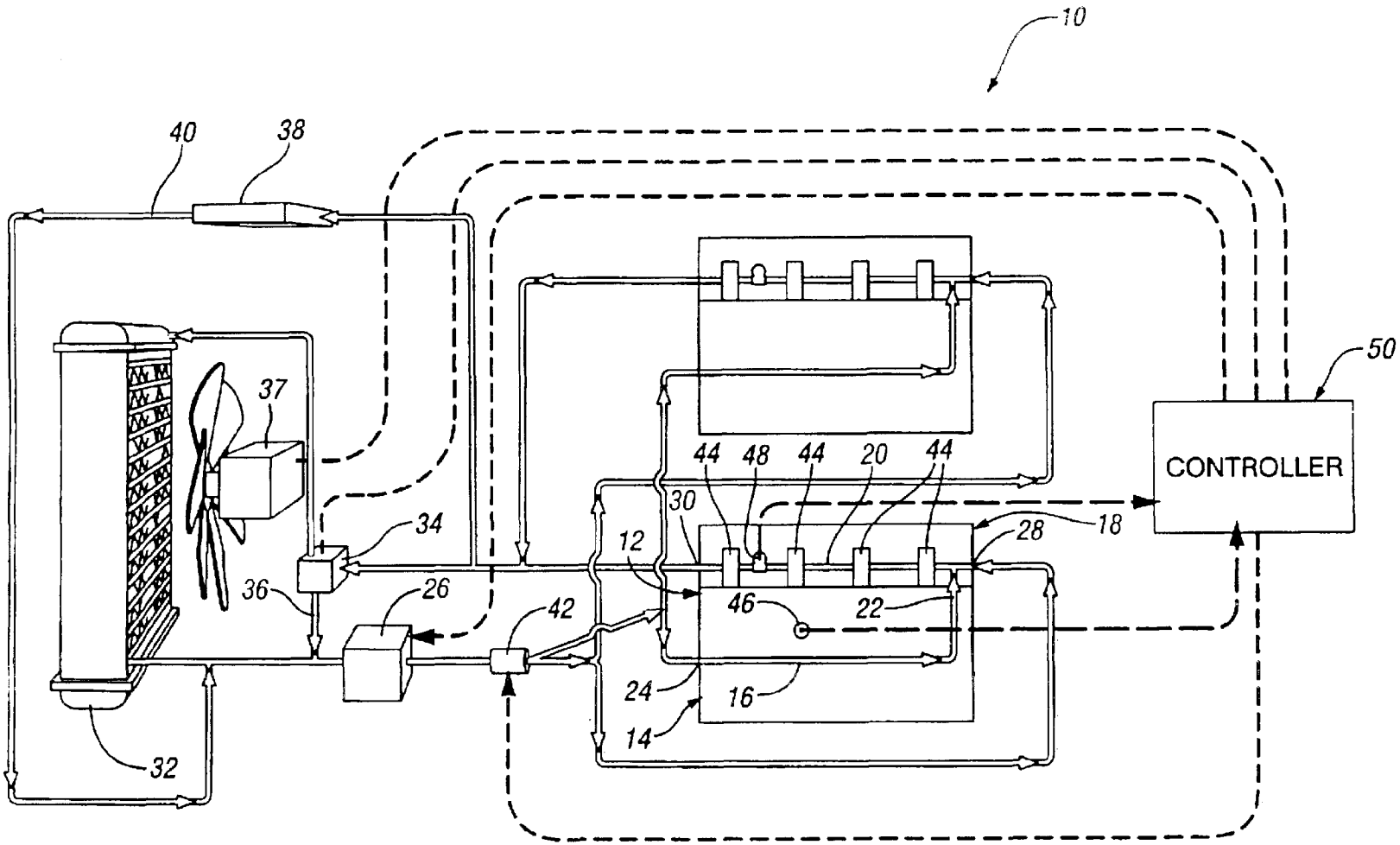
FIG. 1 is a diagrammatic view of an engine cooling system including features according to the present invention.

Referring to FIG. 1 of the drawings in detail, numeral 10 generally indicates a cooling system for an internal combustion engine. System 10 includes an engine 12 having a cylinder block 14 with a cooling jacket 16 and a cylinder head 18 mounted on the cylinder block with a cooling jacket 20. Cooling jackets 16 and 20 are connected by an internal passage 22 between the head 18 and the block 14. A first coolant inlet 24 connects with the cooling jacket 16 of the block 14 and receives coolant from a water pump 26. A second coolant inlet 28 connects with the cooling jacket 20 of the head 18 and also may receive coolant from the water pump 26.

A coolant outlet 30 connects with the cooling jacket 20 of the head 18 and discharges coolant to an ambient air heat exchanger 32 through a temperature control valve 34. The ambient air heat exchanger 32 removes excess heat from the coolant heated in the engine 12. Coolant discharged from the heat exchanger 32 is conducted back to the water pump 26 to be recirculated through the system 10 for cooling the engine 12.

To maintain a desired engine coolant temperature the temperature control valve 34 regulates the amount of coolant flow to the heat exchanger 32 by directing excess coolant flow back to the water pump 26 through a heat exchanger bypass line 36 to avoid overcooling the engine. A heat exchanger fan 37 directs air flow through the heat exchanger to increase the cooling rate of the coolant passing through the heat exchanger. The fan 37 may have a variable pitch blade and/or a reversible motor to change air speed and flow direction through the heat exchanger 32.

Water pump 26 is a controllable flow water pump designed to provide adequate coolant flow at idle as well as at maximum engine loads over the engine speed range. Pump 26 is preferably a variable speed electric water pump but could also be mechanically driven. Alternatively, the pump could use variable pitch vanes or an engine bypass line to vary coolant flow through the engine.

A heater core 38 on the outlet side of the engine provides passenger compartment heat. A heat exchanger bypass 40 directs coolant from the heater core 38 to the water pump 26.

In accordance with the present invention, the system 10 includes a diverter valve 42 that connects the water pump to the first and second coolant inlets 24, 28 of the engine 12 to selectively regulate the amount of coolant flow circulated through the block 14 and the head 18. The diverter valve 42 may direct full coolant flow to the first coolant inlet 24 for passage through both the block and the head in series. The valve 42 may be adjusted to direct a portion of the coolant flow to the second coolant inlet 28. This coolant bypasses the cylinder block 14 and passes through the cylinder head 18, mixing with the portion of coolant coming from the block. This maintains full coolant flow through the head but gives reduced flow through the block.

The diverter valve 42 allows the water pump 26 to operate at a reduced flow rate by selectively directing flow where the engine 12 needs cooling. Thus, as the amount of coolant pumped through the cooling jackets 16, 20 decreases, the energy required to drive the water pump 26 decreases and efficiency of the cooling system 10 increases.

When the diverter valve 42 reduces the flow of coolant to the block 14 and directs the bypassed flow to the head 18, the head may be operated at a cooler temperature than the block 14, which may be more easily maintained at a desired operating temperature. This allows for increased engine efficiency and reduced emissions. Running the head 18 at a lower temperature than the block 14 also reduces the likelihood of knock, and may allow the engine 12 to operate at a higher compression ratio.

System efficiency may also be increased by using heat pipes 44 to carry heat from critical locations, such as valve bridges and spark plug bosses in the cylinder head, to the cooling jacket 20 where it can be conducted to the coolant. The increased thermal conductivity from the heat pipes 44 reduces the amount of coolant needed to cool the engine 12, thereby increasing the efficiency of the system.

A temperature sensor 46 inside the engine block detects the temperature of the block 14 or the temperature of the coolant inside the block 14. An additional temperature sensor 48 in the head 18 of the engine detects the temperature of the head or the temperature of the coolant in the head 18. In addition, sensors 46, 48 indicate the onset of nucleate boiling of coolant inside the block 14 and the head 18 by detecting temperature fluctuations in the head 18 or the block 14. The information collected by the sensors 46, 48 is communicated to a controller 50.

Controller 50 receives information, such as coolant temperature, fuel flow, spark advance, air flow, and engine knock. Based upon established maximum operating temperatures of the engine 12, the controller 50 determines coolant temperature parameters and optimal operating temperatures for the head 18 and the block 14. The controller uses this information to adjust the flow of coolant through the system as needed to provide adequate coolant flow to maintain optimal coolant temperature in the cooling jackets 16, 20 of the engine 12.

In operation, engine coolant flows from the water pump 26 to the diverter valve 42, which controls the diversion of coolant to the cooling jacket 20 of the head 18, which bypasses the cooling jacket 16 of the block 14. The diverter valve 42 can change the relative flow of coolant through the head and the block without changing the speed of the water pump 26.

Coolant from the outlet 30 of the head 18 is directed to the heater core 38 and the temperature control valve 34. The heater core 38 provides heat for the passenger compartment of an associated vehicle. The heat exchanger bypass 40 directs coolant from the heater core 38 to the water pump 26.

The temperature control valve 34 controls coolant temperature by directing coolant through the heat exchanger 32 or through the heat exchanger bypass 36, which carries the coolant back to the water pump 26. The coolant directed through the heat exchanger 32 is cooled and directed to the water pump 26.

As the system 10 operates, the controller 50 monitors coolant temperature, fuel flow rate, airflow rate, and engine knock information. Based upon these factors, the controller 50 determines the appropriate amount of coolant flow through the engine 12 to maintain optimal coolant temperature.

Figure 2:
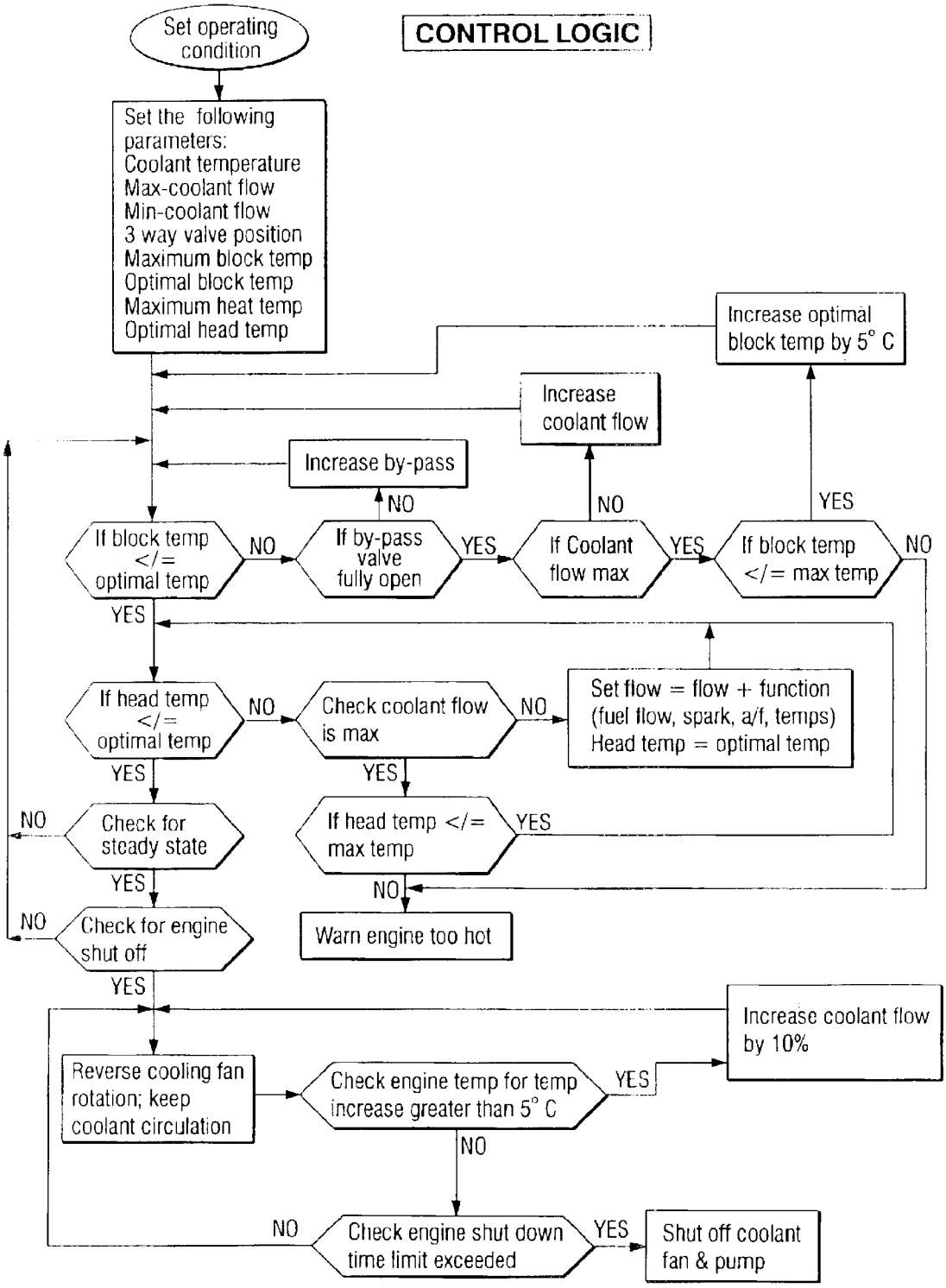
FIG. 2 is a diagram illustrating a controller logic for the cooling system of FIG. 1.

FIG. 2 illustrates an exemplary control logic for operation of the controller 50 in the following situations. Under start up and other low temperature conditions, the controller 50 actuates the temperature control valve 34 to stop coolant flow to the heat exchanger 32, causing the coolant to flow through the heat exchanger bypass 36 to the water pump 26. Bypassing the heat exchanger 32 reduces the circulating volume of coolant through the engine 12 and avoids cooling of this coolant, which reduces the time required to warm the coolant flowing through the engine 12.

To further aid the warm-up process, the controller 50 may stop or reduce the flow of coolant through the system 10 by stopping or slowing down the water pump 26. The sensors 46, 48 continuously monitor the temperature of coolant in the engine to determine the onset of nucleate boiling of coolant in the head 18 and the block 14. If the temperatures in the head 18 or the block 14 exceed the optimal operating temperature, or if the sensors 46, 48 detect nucleate boiling in the engine 12, the controller 50 will increase the flow of coolant through the block 14 or head 18 as needed to prevent nucleate boiling and return the coolant to optimal operating temperatures.

The heat exchanger fan 37 may also aid the warm-up process. The controller 50 may operate the fan 37 in reverse to reduce the amount of airflow through the heat exchanger 32 to decrease the efficiency of the heat exchanger 32 thereby reducing the amount of heat transferred from the heat exchanger 32 to the atmosphere.

As the engine 12 heats up, the controller 50 actuates the diverter valve 42 to provide greater flow through the head 18 and increase system efficiency. Since the head 18 and the block 14 heat at different rates during engine warm-up, the controller 50 alters coolant flow to the head 18 and the block 14 so that the head receives more coolant than the block. As the temperature increases in the head 18 and the block 14, the amount of coolant flow increases accordingly to maintain optimal coolant temperatures in the block 14 and the head 18.

After the block and the head of the engine reach optimal temperature, the amount of coolant supplied is adequate to maintain optimal temperature. To improve engine efficiency and reduce emissions the controller 50 may provide greater coolant flow to the head 18 so that the head 18 runs cooler than the block 14.

When the coolant reaches optimal temperature, the temperature control valve 34 modulates coolant flow through the heat exchanger 32 to maintain the optimal coolant temperature.

If the temperature of the head 18 exceeds the operational parameters, the controller 50 will increase the amount of coolant flow through the head 18 by actuating the diverter valve 42. If the temperature of the block 14 exceeds the operational parameters, the controller 50 will increase the amount of coolant flow through the block 14 by actuating the diverter valve 42. If the temperature of the head 18 and the block 14 both exceed the operational parameters, the controller 50 will increase the overall flow of coolant through the system 10 by increasing the speed of the water pump 26.

The controller 50 may also actuate the temperature control valve 34 to direct all of the coolant through the heat exchanger 32 to decrease the temperature of the coolant in the system 10. Finally, the controller 50 may turn on the heat exchanger fan 37 to increase airflow through the heat exchanger 32 thereby increasing the efficiency of the heat exchanger, and further reducing the temperature of the coolant in the system 10.

If the system 10 is unable to maintain the operational parameters for the engine 12, the controller 50 will give a warning signal. If the temperature of the engine approaches maximum operating temperature, the controller 50 will shut down the engine 12 to prevent overheating.

Under high load or high rpm conditions, the engine 12 develops more heat. The controller 50 increases the speed of the water pump 26 as needed and actuates the diverter valve 42 to direct coolant to the head or the block as needed to maintain the optimal engine temperature.

Under low load or low rpm conditions, the engine 12 develops less heat. The controller 50 reduces the speed of the water pump 26 and actuates the diverter valve 42 to direct more coolant through the head 18 of the engine 12 to reduce the flow path of coolant through the engine 12 and thereby increase system 10 efficiency.

When the engine 12 is shut down, the controller 50 continues to function until the engine 12 is adequately cooled. To prevent heat loading, the controller 50 continues to operate the pump 26 to maintain the flow of coolant through the engine 12. The controller 50 also operates the fan 37 to maintain heat transfer from the heat exchanger 32 to the atmosphere. The controller may also reverse the direction of airflow through the heat exchanger 32 so that air is pulled from under the car and pushed out of the engine compartment through the heat exchanger. After the engine is adequately cooled, the controller 50 stops the pump 26 and fan 37.

The above described cooling system is designed for an inline engine having only one head. However, the cooling system can also be applied to V-type engines having multiple heads and one or more cylinder banks.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A cooling system for a liquid cooled internal combustion engine including a cylinder block having a cooling jacket and a cylinder head mounted on the cylinder block and having a cooling jacket connected with the cooling jacket of the cylinder block for serial coolant flow through the block and the head from a first coolant inlet in the block to a coolant outlet in the head; the improvement comprising:

a second coolant inlet connected with the cooling jacket of the cylinder head;

a controllable flow water pump connected between the coolant outlet and the coolant inlets to pump coolant at variable flow rates through the system;

a heat exchanger connected to discharge excess heat from the coolant leaving the outlet;

the heat exchanger connected with the water pump and the water pump connected with the first coolant inlet in the block for circulating liquid coolant through the system; and a diverter valve connected between the pump and the first and second coolant inlets to the block and head respectively, the diverter valve being operable to modulate coolant flow from the pump between a position of full coolant flow to the first coolant inlet to the cylinder block and a position of full coolant flow to the second coolant inlet to the cylinder head.

2. A cooling system as in claim 1 including a controller responsive to coolant temperatures in the block and the head and operative to control the diverter valve and the controllable flow water pump to maintain the coolant temperatures in a predetermined manner.

3. A cooling system as in claim 1 including at least one thermal sensor monitoring coolant temperature in the cylinder block and at least one thermal sensor monitoring coolant temperature in the cylinder head.

4. A cooling system as in claim 1 including a temperature control valve connected to control coolant flow through the heat exchanger and a bypass between the temperature control valve and the water pump and operable to direct coolant around the heat exchanger.

5. A cooling system as in claim 1 including a heater core connected in parallel with the heat exchanger.

6. A cooling system as in claim 2 wherein the water pump is an electric variable speed pump.

7. A cooling system as in claim 6 wherein the controller regulates the variable speed of the water pump.

8. A cooling system as in claim 6 wherein the water pump is operable to circulate coolant through the system during a cooling period after the engine stops.

9. A cooling system as in claim 8 including a bi-directional fan operable to cool the heat exchanger.

10. A cooling system as in claim 9 wherein the fan is operable in reverse to draw cooler air over the engine and discharge it through the heat exchanger for a cooling period after the engine stops.

11. A cooling system as in claim 4 wherein the controller actuates the temperature control valve.

12. A cooling system as in claim 1 including heat pipes positioned to transfer excess heat from combustion exposed portions of the cylinder head directly to the coolant in the cylinder head jacket.

13. A method for controlling a cooling system of a liquid cooled internal combustion engine including a cylinder block having a cooling jacket and a cylinder head mounted on the cylinder block and having a cooling jacket connected with the cooling jacket of the cylinder block for serial coolant flow through the block and the head from a first coolant inlet in the block and an outlet in the head, a second coolant inlet to the cylinder head coolant jacket, a controllable flow water pump connected between the coolant outlet and the coolant inlets to pump coolant through the system, a heat exchanger connected to discharge excess heat from the coolant leaving the outlet, and a diverter valve connected between the pump and the first and second coolant inlets, the method comprising the step of:

controlling coolant temperatures in the cylinder block and cylinder head by varying as needed the flow of coolant pumped through the system by the pump.

14. A method as in claim 13 including diverting as needed a portion of coolant flow around the block directly to the second inlet of the cylinder head, thereby reducing coolant flow through the block while maintaining total coolant flow through the head.

15. A method as in claim 14 wherein the diversion of coolant is controlled by the diverter valve.

16. A method as in claim 14 wherein varying the flow of coolant includes the step of:

reducing coolant flow from the pump to the engine as needed to warm up the cylinder block and head to predetermined control temperatures.

17. A method as in claim 13 including the step of:

limiting cooling of the coolant by bypassing coolant around the heat exchanger as needed to reach and maintain a desired coolant temperature into the engine.

18. A method as in claim 17 including the step of:

varying air flow through the heat exchanger as needed to control coolant temperature at a desired value leaving the heat exchanger.

19. A method for cooling an engine after shutdown, the method comprising:

reversing air flow of the cooling fan to draw cooler air past the engine to the heat exchanger, thereby cooling the engine with the passing air flow;

continuing coolant flow through the engine and heat exchanger for a period to maintain engine cooling after shutdown until coolant temperature is reduced to a desired value; and using an electric variable speed pump for continuing the coolant flow.

20. A method as in claim 13 including responding to erratic temperature readings in a portion of the engine by increasing coolant flow to the affected engine portion to limit nucleate boiling in the engine.

21. A cooling system as in claim 7 wherein the controller is responsive to erratic temperature readings in the engine to provide increased cooling at the site of the erratic readings to limit the occurrence of nucleate boiling in the cooling system.

* * * * *